US006554623B2

(12) United States Patent
Yoshioka

(10) Patent No.: US 6,554,623 B2
(45) Date of Patent: Apr. 29, 2003

(54) SHIELDED CONNECTOR HAVING A STABLE GROUND

(75) Inventor: Nobuaki Yoshioka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/965,870

(22) Filed: Oct. 1, 2001

(65) Prior Publication Data

US 2002/0042228 A1 Apr. 11, 2002

(30) Foreign Application Priority Data

Oct. 6, 2000 (JP) ..... 2000-307690

(51) Int. Cl.[7] ..... H01R 4/66; H01R 13/648; H01R 9/03

(52) U.S. Cl. ..... 439/98; 439/610

(58) Field of Search ..... 439/98, 610, 939, 439/274, 275, 578

(56) References Cited

U.S. PATENT DOCUMENTS 5,281,167 A * 1/1994 Le et al. ..... 439/578
6,129,585 A * 10/2000 Hashizawa et al. ..... 439/607

FOREIGN PATENT DOCUMENTS

JP 11-126657 5/1999

* cited by examiner

*Primary Examiner*—Lynn D. Feild
*Assistant Examiner*—Chandrika Prasad
(74) *Attorney, Agent, or Firm*—Armstrong, Westerman & Hattori, LLP

(57) ABSTRACT

A shielded connector is provided, by which the performance of electromagnetic shielding and grounding between the connector and a connector-mounting wall of ground side is improved. The shielded connector includes: a first connector having a first inner housing for receiving a first terminal connected to a shielded wire and an electrically conductive shielding shell, which is coated on the outer circumference of the first inner housing and connected to a shielded part of the shielded wire; and a second connector having an electrically conductive shielded terminal resiliently coming in contact with the outer circumference of the shielding shell, an electrically conductive outer housing coming in contact with the shielded terminal for receiving the shielded terminal, a second inner housing inserted in the outer housing, a second terminal inserted in the second inner housing, and an electrically conductive connecting member, which is integrally formed with the outer housing and fixed on a connector-mounting wall of ground side with fixing means. The shielding shell, the shielded terminal, the outer housing and the connecting member are made of non-magnetic material.

6 Claims, 4 Drawing Sheets

SHIELDED CONNECTOR HAVING A STABLE GROUND

BACKGROUND OF THE INVENTION (1) Field of the Invention

The present invention relates to a shielded connector having a structure for carrying out the electromagnetic shielding and grounding to be used for connecting shielded wires to an equipment and the like.

(2) Description of the Related Art

FIG. 6 illustrates an example of a conventional shielded connector to be mounted on a motor vehicle or an electric vehicle. A part of the shielded connector 75 (a female connector 77) is similar to one disclosed in Japanese Patent Application Laid-Open No. H11-126657.

The shielded connector 75 consists of a male connector 76 and the female connector 77. In the present specification, a connector having a connector receiving chamber 78 is defined as the female connector 77 (the left side connector in FIG. 6) while a connector having a part to be received into the connector receiving chamber 78 is defined as the male connector 76 (the right side connector in FIG. 6). FIG. 6 shows a state in which the male and female connectors, 76 and 77, respectively, are fit with each other. The female connector 77 is directly mounted on a connector-mounting wall 79 made of electrically conductive metal of an equipment.

The male connector 76 has a female terminal 81 inside its inner housing 80 made of synthetic resin, then the terminal 81 is connected to a core 83 of a shielded wire 82. The shielded wire 82 consists of the core 83, an inner coat 84 made of electrically insulating resin coating the core 83, a woven metal shield 85 made of electrically conductive metal surrounding the outside of the inner coat 84, and an outer coat 86 made of electrically insulating resin coating the woven metal shield 85.

The woven metal shield 85 is connected to an end of cylindrical shielding shell 87 made of electrically conductive metal at the male connector side and the shielding shell 87 is disposed outside the inner housing 80. The inner housing 80 integrally continues to an outer housing 88 which has a locking arm 89 engaging with the mating female connector 77.

The female connector 77 has a male terminal 91 inside its connector housing 90 made of synthetic resin, an electric contact part of which protrudes in the connector receiving chamber 78. The male terminal 91 is connected to a wire 92 of the equipment side. A cylindrical shielding shell 93 made of electrically conductive metal at the female connector side is disposed along an inner wall surface of the connector receiving chamber 78.

The shielding shell 93 at the female connector side has one resilient contact part 94 coming in contact with the shielding shell 87 at the male connector side at one end of the shielding shell 93 and another resilient contact part 95 coming in contact with the connector-mounting wall 79 of the equipment at another end of the shielding shell 93. The another resilient contact part 95 has a plurality of spring pieces, wherein each spring piece resiliently comes in contact with an inner circumferential surface of a hole in the wall 79 so as to ground both shielding shells 87 and 93. Thereby, noises of electromagnetic waves from the outside of the shielded connector 75, those generated inside the shielded connector 75 and those transmitted through the shielded wire 82 are eliminated to the outside of the shielded connector 75, thereby bad effects of the noises against the equipment are removed. A rear holder 96, which is attached to the rear end of the connector housing 90, prevents the shielding shell 93 from coming off.

However, in the conventional structure of the shielded connector described above, there is a possibility that the permanent strain against the connector-mounting wall 79 and the wear caused by hitting of the resilient contact part 95 of the shielding shell 93 arises being influenced by the strong vibrations during the traveling of the vehicle and the temperature change in the temperature cycle, thereby the shielding performance (i.e., performance of electromagnetic shielding) for the shielded connector deteriorates. In addition, since the contact with the connector-mounting wall 79 is carried out by the resilient contact part 95, therefore the resilient contact part 95 or the inner circumferential surface of the hole in the connector-mounting wall 79 needs surface treatment for wear-resistance or electric conduction with the object of securing the durability, thereby a great deal of time are required and the shielded connector costs high. Furthermore, since the shape of the resilient contact part 95 is complicated, therefore the cost of the shielding shell 93 becomes high.

SUMMARY OF THE INVENTION

It is therefore an objective of the present invention to solve the above problem and to provide a shielded connector, by which the grounding with respect to the connector-mounting wall of the equipment can be always stably carried out without the permanent strain and the wear of the resilient contact part in a severe environment such as the mounting on the vehicle, the electromagnetic shielding performance can be maintained stable, a high electromagnetic shielding performance can be attained, and the cost of the surface treatment of the connector-mounting wall and that of the resilient contact part having a complicated shape can be reduced.

In order to attain the above objective, the present invention is to provide a shielded connector comprising:

a first connector having a first inner housing for receiving a first terminal connected to a shielded wire and an electrically conductive shielding shell, which is coated on the outer circumference of the first inner housing and connected to a shielded part of the shielded wire; and a second connector having an electrically conductive shielded terminal resiliently coming in contact with the outer circumference of the shielding shell, an electrically conductive outer housing coming in contact with the shielded terminal for receiving the shielded terminal, a second inner housing inserted in the outer housing, a second terminal inserted in the second inner housing, and an electrically conductive connecting member, which is integrally formed with the outer housing and fixed on a connector-mounting wall of ground side with fixing means.

With the constitution described above, by an engagement between the first and second connectors, the shielded part of the shielded wire, the shielding shell, the shielded terminal, the electrically conductive outer housing and the connecting member are electrically connected with each other, and in addition, the connecting member is firmly fixed on the connector-mounting wall of the ground side with the fixing means. Therefore, noises from the shielded wire are stably grounded and noises from an equipment are stably grounded to the woven metal shield, thereby the electromagnetic shielding performance can be improved. Especially, instead of the ground connection with the connector-mounting wall by the conventional resilient contact part, a direct grounding is carried out from the connecting member of the electrically conductive outer housing. Therefore, even in a severe environment of the mounting on a vehicle such as vibration and temperature change, the ground connection to the connector-mounting wall of an equipment and the like can be always stably carried out, thereby the electromagnetic shielding performance can be stably maintained high.

Moreover, since the connecting member integrally formed with the electrically conductive outer housing is firmly bonded to the connector-mounting wall by face contact, therefore the shielding shell employing the conventional resilient contact part and the surface treatment of the connector-mounting wall for the purpose of improving the durability are not needed any more, thereby the structure of the shielded connector can be simplified and the cost thereof can be reduced.

Preferably, the shielding shell, the shielded terminal, the outer housing and the connecting member are made of non-magnetic material.

With the constitution described above, no magnetism is generated, for example, due to the external magnetic field, and no new noise is arisen, thereby the electromagnetic shielding performance improves.

Preferably, the shielded terminal has a plurality of resilient contact pieces, which come in contact with the shielding shell, inside the shielded terminal.

With the constitution described above, the electric resistance between the shielding shell and the shielded terminal reduces, thereby the shielding and grounding performance can be excellently maintained.

Preferably, the outer circumference of the shielded terminal comes in contact with the inner circumference of the outer housing.

With the constitution described above, since the shielding shell presses the resilient contact piece inside the shielded terminal toward the outside and the outer circumference of the shielded terminal strongly comes in contact with the inner circumference of the outer housing, therefore the electric connection between the shielding shell and the outer housing is securely carried out, thereby the electromagnetic shielding performance improves.

Preferably, the connecting member is a flange, which is fixed on the connector-mounting wall with a bolt as the fixing means.

With the constitution described above, since the flange of the outer housing strongly comes in contact with the connector-mounting wall of the grounding side by the bolting, therefore the electric connection between the outer housing and the connector-mounting wall improves, thereby the shielding and grounding performance improves.

Preferably, the second inner housing is locked into the outer housing with locking means.

With the constitution described above, since the inner housing can be easily fixed to the outer housing by the locking means, therefore the workability of the mounting and the desorption upon the maintenance improves. In addition, by means of the electrically insulating inner housing, the insulating performance of the second terminal with respect to the electrically conductive outer housing can be excellently secured.

DESCRIPTION OF THE PREFERRED EMBODIMENTS

In the following, the preferred embodiments of the present invention will be explained with reference to the attached drawings.

Figure 1:
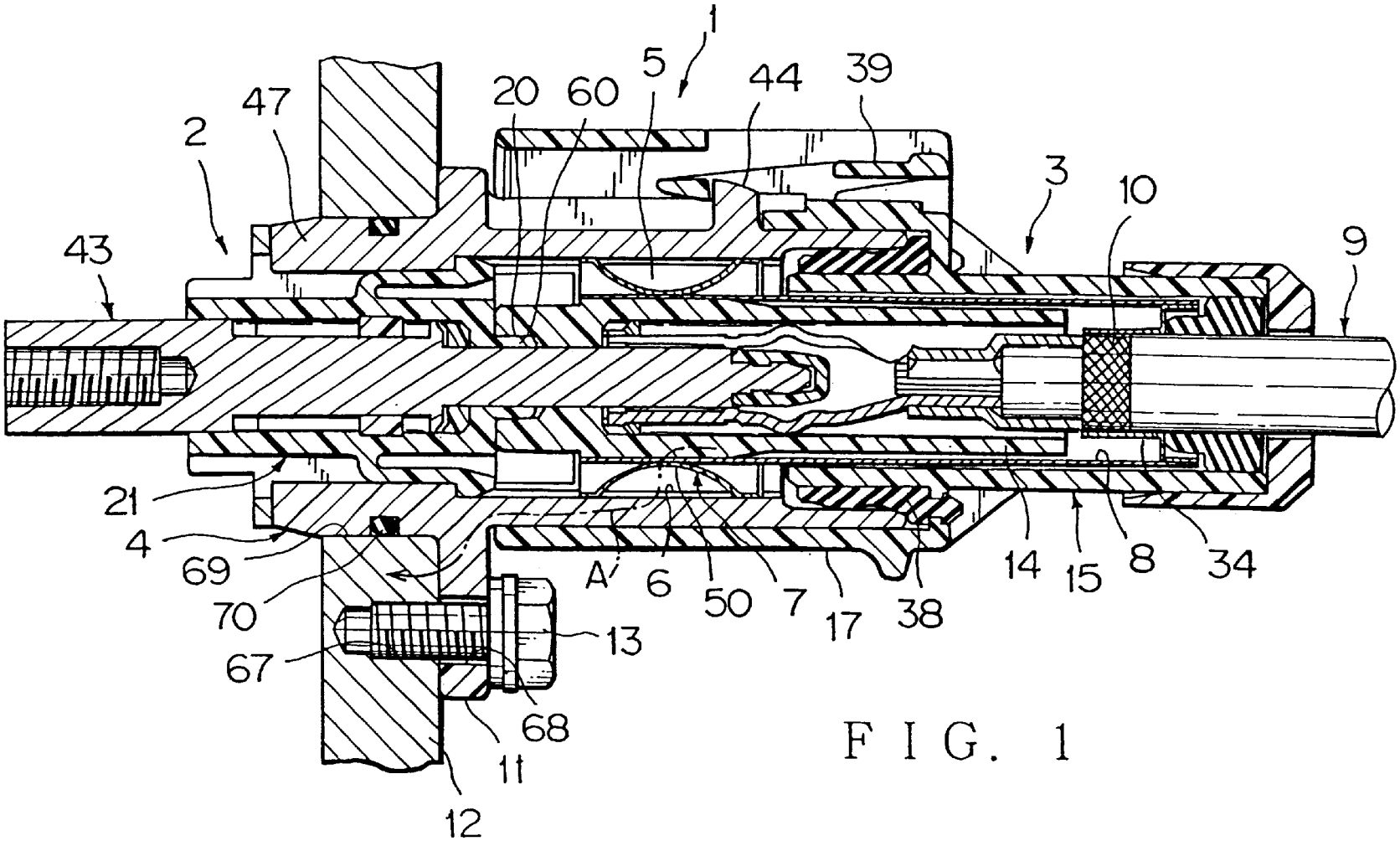
FIG. 1 is a longitudinal sectional view illustrating a shielded connector according to a preferred embodiment of the present invention.

FIG. 1 is a longitudinal sectional view illustrating a shielded connector according to a preferred embodiment of the present invention In the shielded connector 1, an outer housing 4 of a female connector 2 is made of electrically conductive and non-magnetic material, an electrically conductive and non-magnetic ring-shaped shielded terminal 7 is formed by coming in contact with the terminal 7 with an inner wall surface 6 of a connector receiving chamber 5 of the outer housing 4, an electrically conductive and non-magnetic shielding shell 8 is formed at an male connector 3 side, one end of the shielding shell 8 is connected to a woven metal shield 10 of a shielded wire 9 while another end of the shielding shell 8 is connected to the shielded terminal 7, a flange (connecting member) 11 of the outer housing 4, which is electrically connected to the shielded terminal 7, is connected to an electrically conductive connector-mounting wall 12 of an equipment by using a bolt (fixing means) 13.

In FIG. 1, the female connector 2 and the male connector 3 are completely engaged with each other, wherein the woven metal shield 10 of the shielded wire 9 of the male connector side is electrically connected to the connector-mounting wall 12 of the equipment by way of the shielding shell 8, the shielded terminal 7 of the female connector side and the outer housing 4.

Figure 2:
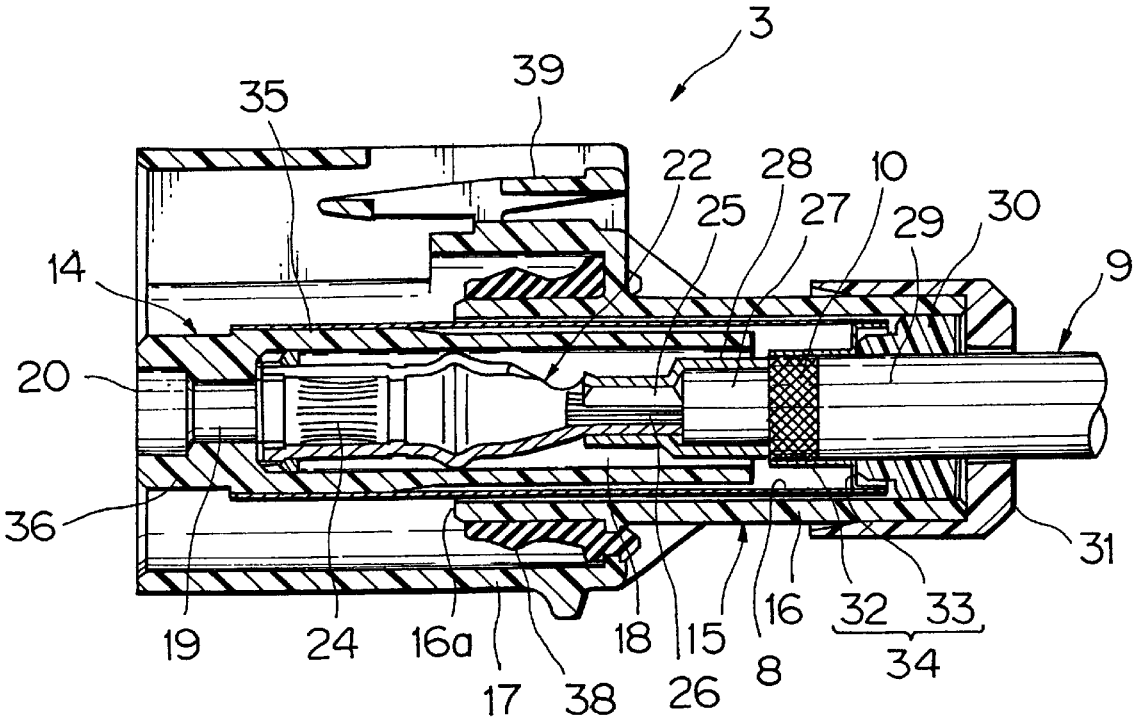
FIG. 2 is a longitudinal sectional view illustrating a male connector of the shielded connector.
Figure 3:
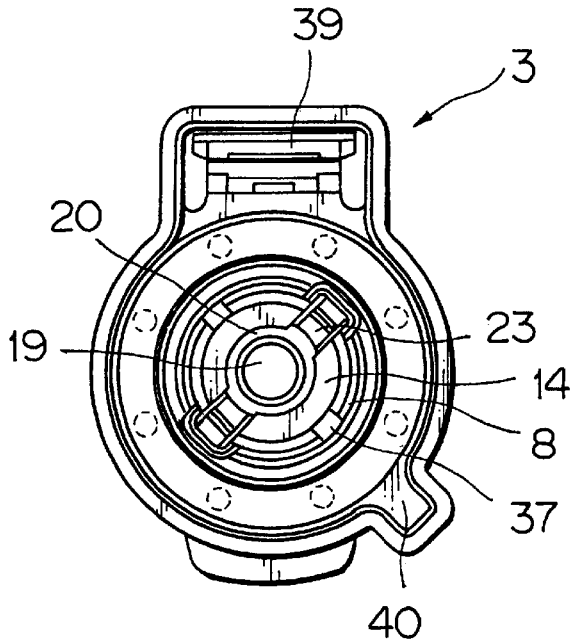
FIG. 3 is a front view illustrating the male connector.

As shown in FIGS. 2 and 3, the male connector has an inner housing 14 made of electrically insulating synthetic resin and an outer housing 15 integrally. The inner housing 14 is formed cylindrical. The outer housing 15 consists of a cylindrical part 16 situated near the outside of the rear half of the inner housing 14 and a hood part 17 covering the front half of the cylindrical part 16, wherein the inner housing 14 and the cylindrical part 16 are connected to each other at a plurality of connection points (not shown in the figure) on the circumference and an end of the inner housing 14 is situated in the same plane with an end of the hood part 17.

The inner housing 14 has a terminal-receiving chamber 18 having a round-shape in the cross section thereof inside the inner housing 14, a mating terminal inserting hole 19 having small diameter, which concentrically communicates with the front of the terminal-receiving chamber 18, and a mating housing engaging hole 20 having medium diameter for positioning the mating inner housing 21 (see FIG. 1). A female terminal 22 having wire is inserted into the terminal-receiving chamber 18 and locked for preventing from coming out by a pair of locking arms 23 (see FIG. 3).

The female terminal 22 has a resilient contact part 24 at front and a wire connection part 25 at rear, wherein the resilient contact part 24 has a plurality of spring pieces on the circumference thereof and the wire connection part 25 is connected to a core 26 of the shielded wire 9 by caulking, and an electrically insulating heat-shrinkable tube 28 is coated on the outside of the wire connection part 25 and an inner coat 27 of the shielded wire 9.

At the rear of the inner coat 27, the woven metal shield 10 having relatively large diameter is situated on the outer circumference of an outer coat 29 being folded back. The outer coat 29 is inserted into a waterproof rubber stopper 30 and guided from a hole of a rear holder 31 made of synthetic resin toward the rear. The rear holder 31 is locked to the cylindrical part 16 of the outer housing 15 by locking means (not shown in the figure) to prevent the waterproof rubber stopper 30 from coming out.

A cylindrical part 32, which is a front half of an electrically conductive and non-magnetic ring-shaped shielded terminal 34, is connected to the outer circumference of the woven metal shield 10 by caulking, the cylindrical part 32 is integrally connected to a rear ring-shaped shield contact part 33 having large diameter and a L-shape in the cross section, the shield contact part 33 is press-in connected to the inner surface of the rear end of the electrically conductive and non-magnetic cylindrical shielding shell 8, which is situated along the outside of the inner housing 14 and adheres to the outer circumferential surface of a large diameter part, which is a front half of the inner housing 14. The shielded terminal 34, which has the cylindrical part 32 and the shield contact part 33 integrally, is made of, for example, aluminum.

The shielded terminal 34 is fit over and caulked to the woven metal shield 10 of the shielded wire having wire, then the shielding shell 8 is pressed in the shield contact part 33. Then, the shielding shell 8 is fit over the inner housing 14.

The circumferential wall of the shielding shell 8 is situated between the inner housing 14 and the cylindrical part 16 of the outer housing 15 without coming in contact with leaving a small gap therebetween except the portion, which comes in contact with the large diameter part 35 at the front end of the inner housing 14. The large diameter part 35 continues to the medium diameter part 36 at the front end side, and the mating terminal-receiving hole 19 and the mating housing engaging hole 20 are situated concentrically with each other inside the medium diameter part 36. The front half of the shielding shell 8 is exposed to the outside of the inner housing 14, and the front end 16a of the cylindrical part 16 of the outer housing 15 is situated at the middle of the length direction of the shielding shell.

The shielding shell 8 is locked to the outer circumference of the inner housing 14 by a locking member 37 (see FIG. 3). The shielding shell 8 covers the female terminal 22 having wire over the range from the rear of the woven metal shield 10 of the shielded wire 9 to the front of the front end of the female terminal 22, thereby completely preventing the external electromagnetic waves from entering or the internal electromagnetic waves from leaking. The shielded terminal 34 seals the rear end side of the shielding shell 8, thereby completely preventing the external electromagnetic waves from entering or the internal electromagnetic waves from leaking. A small diameter part of the front half of a waterproof rubber stopper 30 enters into a hollowed space at the inside of the shield contact part 33 and is situated there. The outer circumference of the large diameter part 30 of the rear half of the waterproof rubber stopper 30 adheres to the inner circumferential surface of the cylindrical part 16 of the outer housing 15.

Since the shielding shell 8 and the shielded terminal 34 is made of non-magnetic material, therefore they are never magnetized and never generate the electromagnetic wave (magnetic field) by themselves. Therefore, bad effect of the noises against the equipment and so on through the male and female terminals, 43 and 22 respectively, can be securely prevented from occurring.

A waterproof packing 38 is fit over the outer circumference of the front end side of the extension of the outer housing 15, a hood part 17 is situated at the outside of the waterproof packing 38, and a locking arm 39 for locking the mating female connector 2 at the inside of the rear half of the hood part 17. In FIG. 3, abbreviation numeral 40 denotes a guiding groove for preventing a fault of engagement of the connectors.

Figure 4:
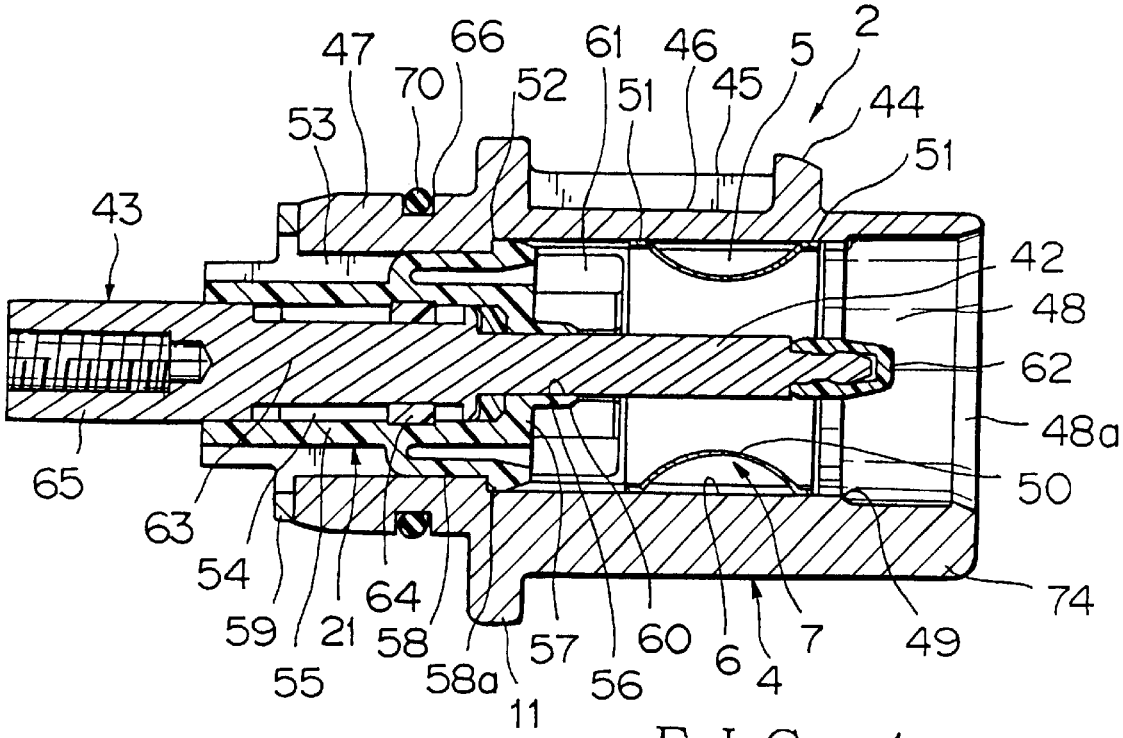
FIG. 4 is a longitudinal sectional view illustrating a female connector of the shielded connector.
Figure 5:
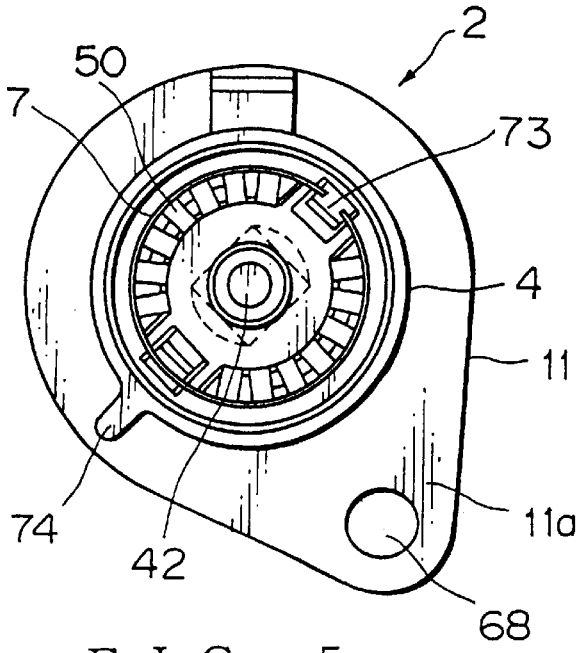
FIG. 5 is a front view illustrating the female connector.
Figure 6:
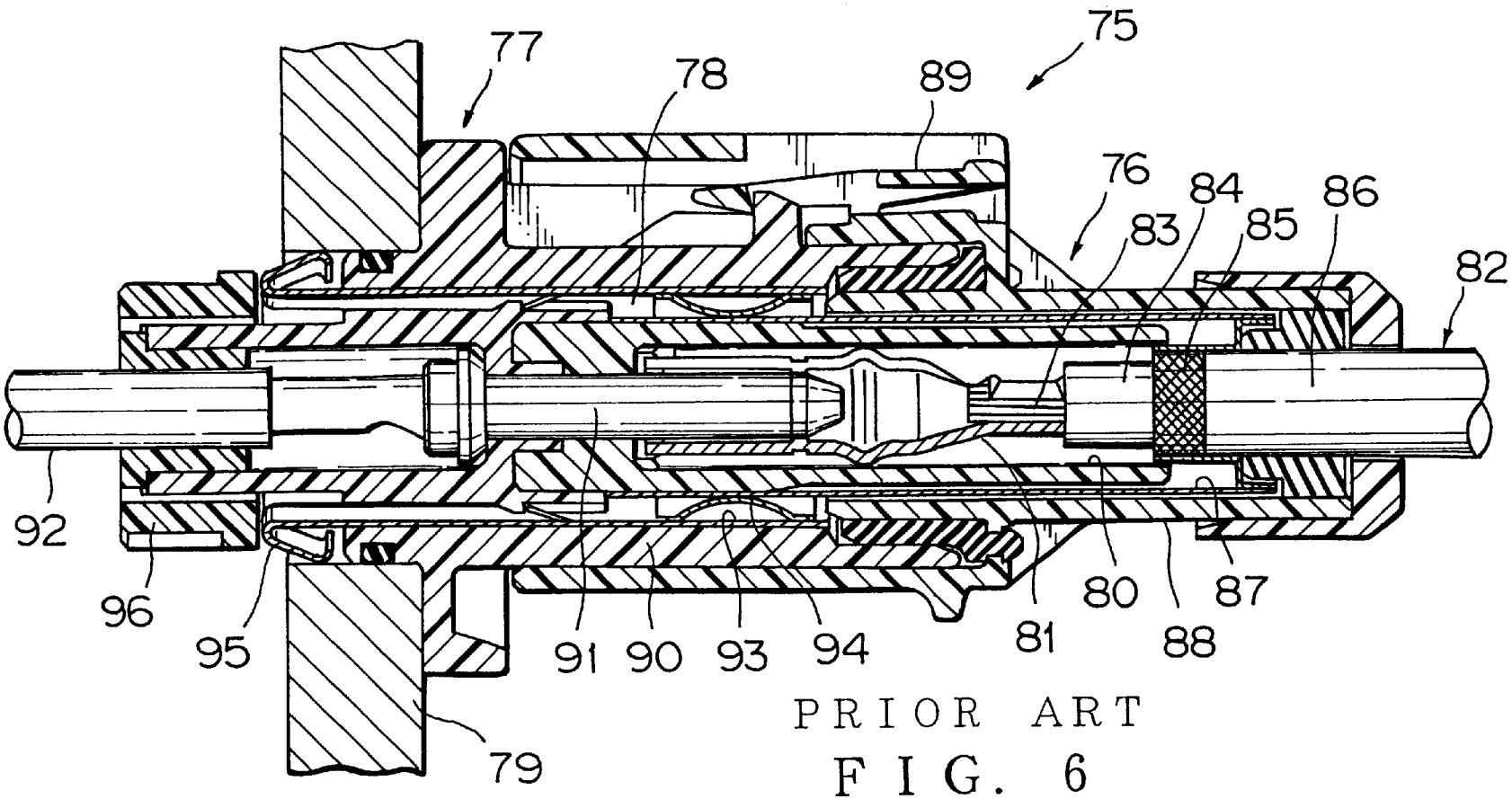
PRIOR ART FIG. 6
FIG. 6 is a longitudinal sectional view illustrating an example of a conventional shielded connector.

As shown in FIGS. 4 and 5, the female connector 2 has a cylindrical outer housing 4, which is made of electrically conductive and non-magnetic material such as aluminum, a cylindrical inner housing 21 that is electrically insulating and thermoplastic resin arranged inside the rear half of the outer housing 4, a male terminal 43, the middle part of the length direction of which is received in the inner housing 21 and an electric contact part 42 of the front half having a pin-shape of which protrudes in the receiving chamber 5 of the outer housing 4, and a male terminal 7 arranged coming in contact with the inner wall surface 6 of the receiving chamber 5 outside the electric contact part 42. In this connection, the front side is defined as the end side of the connector 2.

The outer housing 4 integrally has a flange 11 outwardly at the middle of the length direction, and a locking projection 44 engaging with the locking arm 39 (see FIG. 2) and a guiding wall 45 at the front half thereof. The outer housing 4 is easily formed with casting or forging, for example, aluminum material, which is electrically conductive and non-magnetic. Taking the flange 11 as a boundary, the circumferential wall 46 of the front half of the outer housing 4 is thin while the circumferential wall 47 of the rear half thereof is thick, and each wall 46 or 47 is formed having a uniform thickness in the circumferential direction. In FIG. 5, an abbreviation numeral 74 denotes a guiding rib engaging with the guiding groove 40 (see FIG. 3).

The outer housing 4 is formed having a large inner diameter from an opening 48*a* at the front end of the outer housing 4 to a little inside thereof, a medium diameter chamber (5) is formed at rear from the large diameter chamber 48 via a step 49, and the shielded terminal 7 is arranged in the medium diameter chamber 5. The large diameter chamber 48 and the medium diameter chamber 5 constitute the connector-receiving chamber 5. The shielded terminal 7 is formed in a ring-shape and has a plurality of spring pieces (resilient contact part) 50 in the circumferential direction as shown in FIG. 5, wherein each spring piece 50 inwardly bends in an arc-shape and appears to have a hand drum as a whole. For example, a piece of long from side to side metal plate, which is electrically conductive and non-magnetic, is punched at the middle in the back and front direction by pressing so as to have a slit-shape, thereby forming a plurality of contact spring pieces 50, then the spring piece 50 is bent inwardly with the metal plate being bent in a ring-shape, thereby the shielded terminal 7 is easily formed.

Each of the front and rear ends of the shielded terminal is formed with a short ring-shaped part 51 having large diameter, and the outer circumferential surface of the ring-shaped part 51 comes in contact with the inner surface 6 of the circumferential wall of the outer housing 4. The shielded terminal 7 is locked by a pair of the locking arms 73 (see FIG. 5) at the inner circumference side of the outer housing 4.

In this connection, a plurality of thin protrusive stripes may be formed having a constant space therebetween on the inner circumference of the outer housing 4 so that the inner surface of the protrusive stripe comes in contact with the outer circumferential surface of the ring-shaped part at the front and rear of the shielded terminal 7. Alternatively, the shielded terminal 7, which is bent in a ring-shape, may be adhered to the inner circumference 6 of the circumferential wall of the outer housing 4 by using a restoring force in the outer diameter direction. Alternatively, when the metal plate is bent in a ring-shape to form the shielded terminal 7, a locking projection (not shown in the figure) having a groove for engaging junction parts at both ends of the metal plate may be integrally formed on the inner circumference of the outer housing 4. Alternatively, a surface treatment such as tinning may be carried out with respect to the inner circumferential surface and/or the outer circumferential surface of the shielded terminal 7, or the inner circumferential surface and/or the outer circumferential surface of the outer housing 4, or the flange 11 in order to improve the electric conduction and the corrosion resistance thereof.

The medium diameter chamber 5 of the outer housing 4 continues to a rear small diameter chamber 53 inside the flange 11 through a step 52. The inner housing 21 made of the electrically insulating resin is inserted in the small diameter chamber 53. The inner housing 21 includes a cylindrical part 55 having a terminal-receiving chamber 54 therein, a partition wall 57 having a terminal insertion hole 56 at the front end of the cylindrical part 55, a pair of flexible locking arms (locking means) 58 formed facing front from the outer circumferential surface of the cylindrical part 55, and a flange 59 situated outside the cylindrical part 55.

The inner housing 21 is inserted in the small diameter chamber 53 from the rear, a projection 58*a* of the locking arm 58 engages with a step (locking means) 52, and the flange 59 abuts against the rear end of the outer housing 4, thereby the inner housing 21 is fixed being prevented from moving in the back and forth direction. The inner housing 21 can be easily inserted. On the periphery of the terminal insertion hole 56, a ring-shaped projection 60 is extendedly formed in front from the partition wall 57 and the inner circumference of the projection 60 constitutes a part of the terminal insertion hole 56. Between the partition wall 57 and the rear end of the shielded terminal 7, for example, a plurality of spacing walls 61 are formed in the circumferential direction having a constant space therebetween.

The pin-shaped electric contact part 42 of the male terminal 43 is inserted in the resilient contact part 50 of the shielded terminal 7 being situated at the center of the resilient contact part 50 through the insertion hole 56 of the inner housing 21, and the front end of the electric contact part 42 is situated protruding in a little more front compared to the front end of the shielded terminal 7. The front end of the electric contact part 42 is capped with a cap 62 made of insulating resin and the rear end of the cap 62 is situated backward compared to the front end of the shielded terminal 7. Consequently, the electric contact part 42 is covered over the full length thereof by the non-magnetic outer housing 4, the middle part of the electric contact part 42 is covered by the non-magnetic shielded terminal 7, and in addition, the front part near to the opening 48*a* is covered by the non-magnetic cap 62, thereby the external electromagnetic waves are prevented from entering into the male terminal 43 and the internal electromagnetic waves are prevented from leaking out outside from the terminal 43.

The electric contact part 42 of the male terminal 43 is prevented from vibrating by the long terminal insertion hole 56 of the inner housing 21, thereby the centering is accurately carried out. In the terminal-receiving chamber 54 of the inner housing 21, a cylindrical part 63 at the middle of the male terminal 43 is fixed immovable by front and rear locking members 64. A large diameter connection part 65 protruding backward from the terminal-receiving chamber 54 is connected to a wire (not shown in the figure) at the equipment side by caulking or connected to a terminal (not shown in the figure) at the equipment side by screwing. The connection of the wire by caulking is carried out in a state of the terminal alone.

Outside the inner housing 21, the outer circumference of the outer housing 4 is provided with a circumferential groove 66, into which an O-ring 70 is put as a packing. As shown in FIG. 5, the flange 11 of the outer housing 4 significantly protrudes like a cam, at a protruding portion 11*a* of which a bolt insertion hole 68 for a female screw hole 67 of the mounting wall 12 (see FIG. 1) of the equipment is formed.

As shown in FIG. 1, the male connector 3 is fit into the female connector 2 in a state that the female connector 2 is fixed to the mounting wall 12 made of electrically conductive metal of the equipment by a bolt 13. The rear end side of the outer housing 4 of the female connector 2 is inserted into a round hole 69 of the mounting wall 12, the O-ring 70 adheres to the inner circumferential surface of the hole 69, the bolt 13 is inserted into the hole 68 of the flange 11 and inserted into the female screw hole 67 in the mounting wall 12 by screwing. By the bolting, the rear surface of the flange 11 comes in contact with the front surface of the mounting wall 12 with a very strong pressure. The circumferential wall 47 at the rear end side of the outer housing 4 comes in contact with the inner circumferential surface of the hole 69 of the mounting wall 12.

In this connection, the mounting wall 12 may be made of non-magnetic metal or insulating resin so as to form an electrically conductive layer only on the surface thereof. The position of the mounting wall 12 is not limited to a wall portion of the equipment and may be a body panel (not shown in the figure) of a vehicle.

The woven metal shield 10 of the shielded wire 9 is connected to the shielding shell 8 through the shielded terminal 34 in the male connector 3, the shielding shell 8 resiliently comes in contact with the shielded terminal 7 of the female connector 2, the shielded terminal 7 comes in contact with the outer housing 4, which is electrically conductive and non-magnetic, and the outer housing 4 is strongly pressed against the mounting wall 12 at the flange 11, thereby as shown by an arrow A in FIG. 1, noises from the shielded wire 9 is securely grounded to the mounting wall 12 of the equipment by way of the shielding shell 8, the shielded terminal 7 and the outer housing 4.

Since the shielded terminal 34 and the shielding shell 8 of the male connector 3, and the shielded terminal 7 and the outer housing 4 of the female connector 2 are all made of non-magnetic material, therefore no external noise (electromagnetic wave) can enter into each element 34, 8, 7 or 4, and no element 34, 8, 7 or 4 is magnetized to generate noises, thereby the electromagnetic shielding and grounding are securely carried out.

Upon fitting of the male and female connectors with each other, the front half of the inner housing 14 of the male connector 3 enters into the receiving chamber 5 of the female connector 2 and is inserted in the resilient contact part 50 of the shielded terminal, then the front end side of the shielding shell 8 at the outer circumference side of the inner housing 14 resiliently comes in contact with the resilient contact part 50. At the same time, the ring-shaped projection 60 of the inner housing 21 of the female connector 2 enters into the insertion hole 20 at the front end side of the inner housing 14 and engages there, thereby the inner housings 14 and 21 are accurately positioned with each other without a gap in centering. Thereby, the contact between the shielded terminal 7 and the shielding shell 8 is securely carried out without a gap in centering. The front-end surfaces of the inner housings 14 and 21 abut against each other. The outer housing 4 of the female connector 2 fits inside the hood part 17 of the male connector 3. The waterproof packing 38 adheres to the outer housings 4 and 15 therebetween. The locking projection 44 engages with the hole of the locking arm 39, thereby both connectors 2 and 3 are fixed being prevented from coming off.

The outer housing 4 at the female connector side may be made of electrically insulating synthetic resin, on the surface of which an electrically conducive layer is formed, for example, by plating. In this case, the conductive layer is preferably non-magnetic. Instead of the flange 11, a bracket (not shown in the figure) and the like may be employed as the connecting member for the connector-mounting wall 12. Instead of the woven metal shield 10, copper foil (not shown in the figure) and the like may be employed as the shielded part of the shielded wire 9. Each construction mentioned above is also effective as a grounding structure or a connecting structure of the shielded connector 1.

The aforementioned preferred embodiments are described to aid in understanding the present invention and variations may be made by one skilled in the art without departing from the spirit and scope of the present invention.

What is claimed is:

1. A shielded connector comprising:

a first connector having a first inner housing for receiving a first terminal connected to a shielded wire and an electrically conductive shielding shell, which is coated on the outer circumference of the first inner housing and connected to a shielded part of the shielded wire; and a second connector having an electrically conductive shielded terminal resiliently coming in contact with the outer circumference of the shielding shell, an electrically conductive outer housing coming in contact with the shielded terminal for receiving the shielded terminal, a second inner housing inserted in the outer housing, a second terminal inserted in the second inner housing, and an electrically conductive connecting member, which is integrally formed with the outer housing and fixed on a connector-mounting wall of ground side with fixing means.

2. The shielded connector according to claim 1, wherein the shielding shell, the shielded terminal, the outer housing and the connecting member are made of non-magnetic material.

3. The shielded connector according to claim 1 or 2, wherein the shielded terminal has a plurality of resilient contact pieces, which come in contact with the shielding shell, inside the shielded terminal.

4. The shielded connector according to claim 1 or 2, wherein the outer circumference of the shielded terminal comes in contact with the inner circumference of the outer housing.

5. The shielded connector according to claim 1 or 2, wherein the connecting member is a flange, which is fixed on the connector-mounting wall with a bolt as the fixing means.

6. The shielded connector according to claim 1 or 2, wherein the second inner housing is locked into the outer housing with locking means.

* * * * *